US006167598B1

(12) United States Patent
Pransky et al.

(10) Patent No.: US 6,167,598 B1
(45) Date of Patent: Jan. 2, 2001

(54) CLOSURE DEVICE

(75) Inventors: Jerome C. Pransky, Marina Del Rey, CA (US); Thomas S. Weaver, Shelburn, VT (US)

(73) Assignee: Smart Stuff, LLC, Marina del Rey, CA (US)

( * ) Notice: Under 35 U.S.C. 154(b), the term of this patent shall be extended for 0 days.

(21) Appl. No.: 09/176,398

(22) Filed: Oct. 21, 1998

(51) Int. Cl.[7] ..... A43C 7/00
(52) U.S. Cl. ..... 24/712.9
(58) Field of Search ..... 24/712.4, 712.9, 24/712.7, 712.2, 712.3, 115 H, 129 R, 130, 129 D; 36/50.1

(56) References Cited

U.S. PATENT DOCUMENTS 3,066,370 * 12/1962 Epstein .
3,296,669 * 1/1967 Elder, Jr. .
3,345,707 * 10/1967 Rita .
4,884,321 12/1989 Holub .

* cited by examiner

*Primary Examiner*—James R. Brittain
(74) *Attorney, Agent, or Firm*—Blakely, Sokoloff, Taylor & Zafman

(57) ABSTRACT

An apparatus for providing easy tightening and loosening of laces. A molded unit having a top, two ends, and two sides is formed. Each end may be molded or tooled to define a first bore and a portion of a guide channel. The top is molded or tooled to define a second portion of the guide channel having a cross-dimension greater than a cross-dimension of the first bore. The first bore, first portion of the guide channel and the second portion of the guide channel corresponding to one end are contiguous. In one embodiment, each end further defines a second bore that is not contiguous with the first bore or guide channel through which a lace may be secured.

4 Claims, 2 Drawing Sheets

CLOSURE DEVICE

BACKGROUND OF THE INVENTION (1) Field of the Invention

The present invention relates to a shoelace tightening and loosening device. More specifically, the invention relates to a device that permits drawstrings on laces to be tightened and loosened without retying.

(2) Background

Some people, particularly, young children and elderly, may have difficulty tying their shoes, either because they have not yet learned to tie their shoes or because arthritis or other physical disability makes it difficult to manipulate the laces.

Various related products have come on the market to address this problem. One such product is sold under the trademark BUNJEEZ®. The BUNJEEZ® product is designed to convert conventional tennis shoes or athletic shoes having elastic laces into slip-on shoes. It is designed to hold the laces in a permanently fixed tightness. It does not provide for easy adjustment of the shoe laces so that the shoe can be tightened or loosened conveniently. Thus, it is not likely to be suitable for actual sports wear, since it is often desirable to be able to tighten the laces to provide additional support of the athlete's foot. Another product marketed under the trademark EASY LACES® and manufactured by Stretch-Lace Company, Norwood, Mass., is described in U.S. Pat. Nos. 3,132,390 and 4,102,019. This device having multiple parts suffers from a difficulty of use coupled with increased manufacturing costs and relatively poor durability.

In view of the foregoing, it would desirable to have a better device for tightening and loosening laces that is inexpensive to manufacture, durable, and easy to use.

BRIEF SUMMARY OF THE INVENTION

An apparatus for providing easy tightening and loosening of laces is disclosed. A molded unit having a top, two ends, and two sides is formed. Each end may be molded or tooled to define a first bore and a portion of a guide channel. The top is molded or tooled to define a second portion of the guide channel having a cross-dimension greater than a cross-dimension of the first bore. The first bore, first portion of the guide channel and the second portion of the guide channel corresponding to one end are contiguous. In one embodiment, each end further defines a second bore that is not contiguous with the first bore or guide channel through which a lace may be secured.

DETAILED DESCRIPTION OF THE INVENTION

Figure 1:
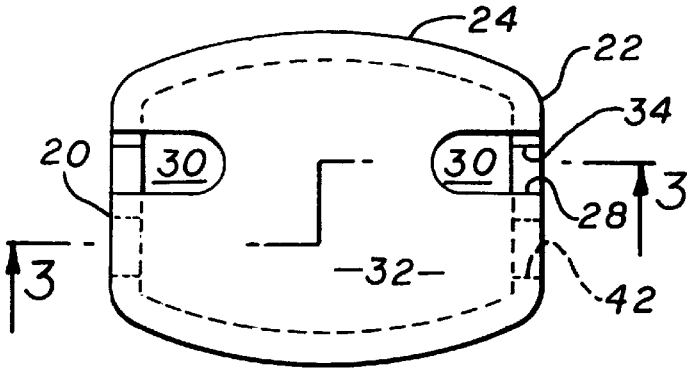
FIG. 1 is a top plan view of one embodiment of the invention.

FIG. 1 is a top plan view of one embodiment of the invention. A top panel 32 is integrally molded with or coupled to end panels 22 and side panels 24, which in combination define a volume. End panels 22 define a first bore 28 and a second bore 42. Additionally, end panel 22 defines a first portion of a guide channel 26 which is contiguous with bore 28. A retaining protrusion 34 defines a portion of the periphery of bore 28. The top panel 32 defines a second portion of the guide channel 30, which is contiguous with the first portion of the guide channel 26.

Figure 2:
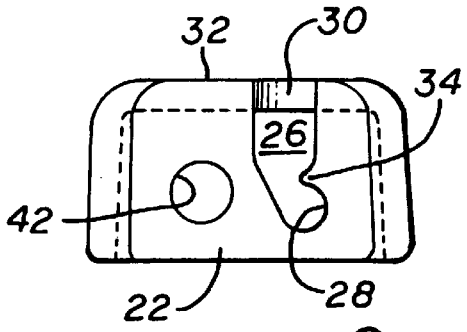
FIG. 2 is an end plan view of one embodiment of the invention.

FIG. 2 is an end plan view of one embodiment of the invention. This plan view betters shows first bore 28, second bore 42, and first portion of the guide channel 26. While bores 28 and 42 are shown as substantially circular, it is within the scope and contemplation that the bores be any manufacturable shape. The opposite end of the shown embodiment is a mirror image of that shown in FIG. 2.

Figure 3:
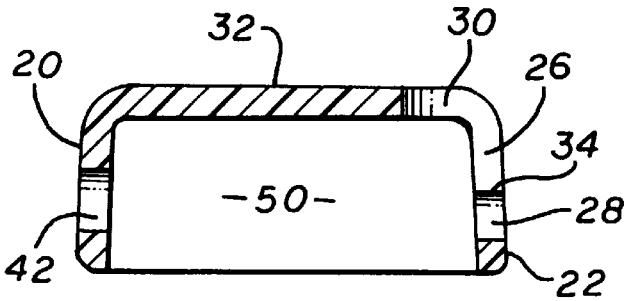
FIG. 3 is a sectional view of the embodiment of FIG. 1.
Figure 4:
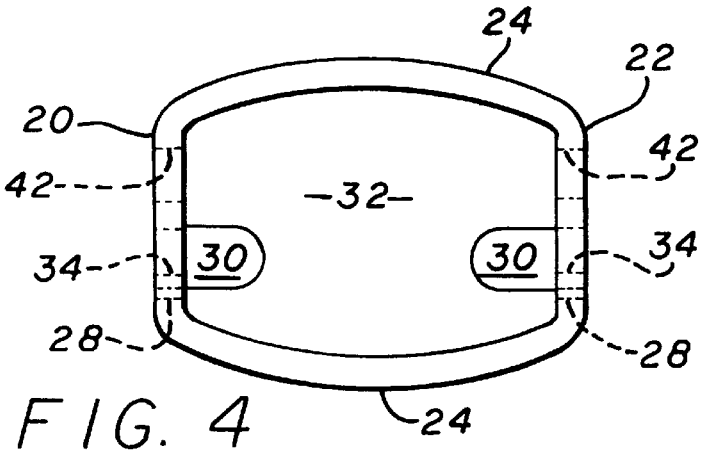
FIG. 4 is a bottom plan view of the embodiment of FIG. 1.

FIG. 3 is a sectional view of the embodiment of FIG. 1. FIG. 4 is a bottom plan view of the embodiment of FIG. 1.

Figure 5:
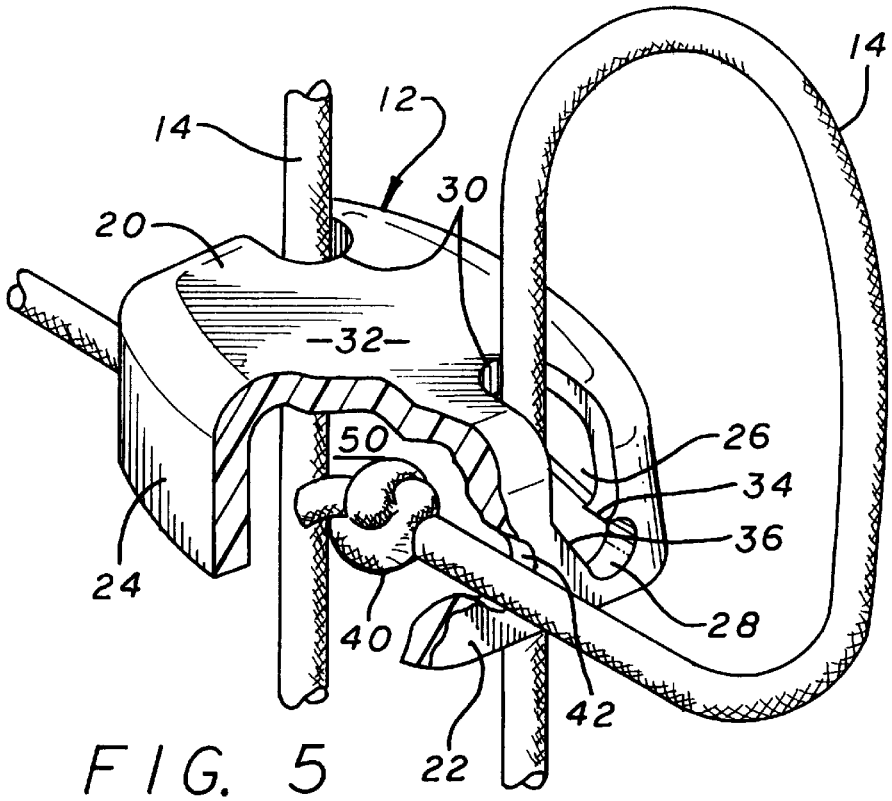
FIG. 5 is a partial cutaway perspective view of the closure device of one embodiment of the invention.

FIG. 5 is a partial cutaway perspective view of the closure device of one embodiment of the invention. As shown, lace 14 terminates in a knot 40 which is retained within volume 50 because its size is insufficiently small to pass through second bore 32, which in one embodiment is also defined by end panel 22.

The device 12 includes a top panel 32 integrally molded with a pair of side panels 24 and a pair of end panels 22. The end panels 22 define a first bore 28 having a first diameter (or cross-dimension if the bore is not round). As used herein, "diameter" and "cross-dimension" are deemed equivalent. First bore 28 is contiguous with a first portion of a guide channel 26, also defined by the end panel 22. The top 32 defines a second portion of the guide channel 30. The first and second portions of the guide channel 26 and 30, respectively have a maximum cross dimension greater than the first diameter. A retaining protrusion 34 protrudes into the guide channel and defines a portion of the perimeter of the first bore 28. An opposing side of the guide channel terminates in a downward sloping segment 36 which directs a lace pulled laterally from the guide channel into the first bore 28.

To install the device on a lace, a free end of the lace is passed through the guide channel 26, 30 and then through second bore hole 42 defined in the end 22. The free end of the lace is then knotted to form a knot 40 which cannot pass back through second bore 42. The knot is then retained within volume 50, defined by the aggregate of the two ends, two sides, and top. If a user pulls laterally outward on the loop of lace 14, the lace will be pulled from the second portion of the guide channel through the first portion of the guide channel into the first bore 28. In one embodiment having second bore 42 defined to have its center below the level of the retaining protrusion 34, the lace will naturally seat in the first bore 28 responsive to a lateral pull on the loop. The diameter of the first bore 28 is selected to be less than the diameter of the unstretched lace 14 and greater than the minimum diameter of the lace 14 in a fully stretched condition. Opposing tension on the lace 14 will cause lace 14 to be stretched and moved through bore 28 to a tightened position. When a user releases the tension on the loop of the lace 14, the diameter of the lace 14 at the bore 28 will grow such that frictional engagement between the sides of the bore 28 and the lace 14 will lock the lace 14 in a tightened position. The opposite end is a mirror image of the end detail and the steps for installing the lace are analogous.

Figure 6:
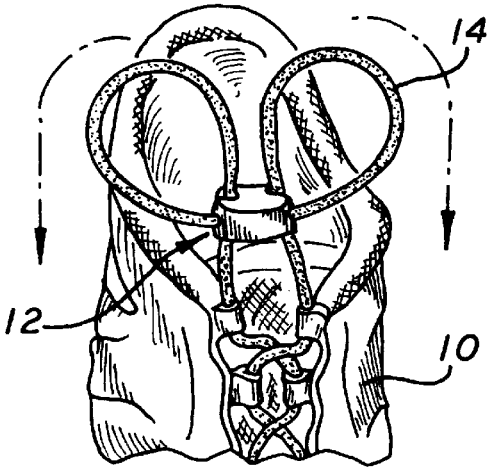
FIG. 6 is a perspective view of one embodiment of the closure device installed on a shoe in an unlocked position.
Figure 7:
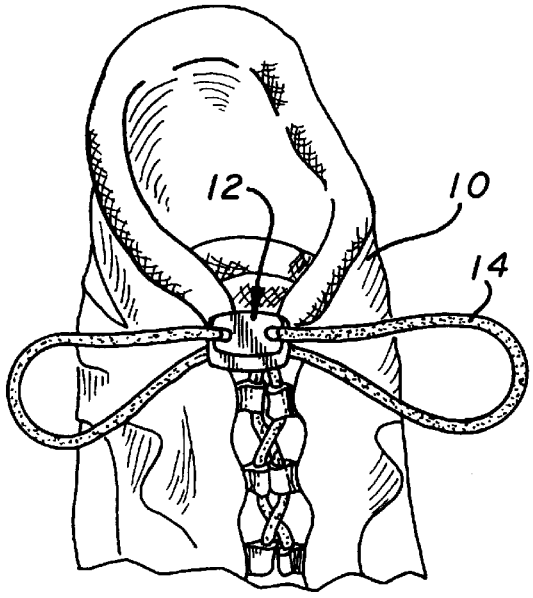
FIG. 7 is a perspective view of the closure device of one embodiment of the invention in a tightened, locked position.

FIG. 6 is a perspective view of one embodiment of the closure device installed on a shoe in an unlocked position. The closure device 12 is coupled around a pair of shoelaces 14 which are laced through a shoe 10. In this embodiment, the laces 14 are shown in the unlocked position. When in this position, one need merely grasp the tightening device 12 and raise it away from the shoe and it will freely rise up the laces 14, thereby loosening the shoe on a user's foot. FIG. 7 is a perspective view of the closure device of one embodiment of the invention in a tightened, locked position.

In addition to shoes, many items including such things as pants, shorts, backpacks, and others employ tying closure mechanisms. It is within the scope and contemplation of the invention to employ the invention on such other items. By way of example, shorts or pants having a drawstring could employ an embodiment of the invention instead of requiring users to tie the drawstring. Notably, if the embodiment is made of thermoplastic, it can be produced in a wide variety of colors such that it may be made consistent with the color of clothing on which used.

In the course of manufacture, one embodiment of the invention may be installed central to a continuous lace rather than at the free ends retained by knots. In such case, the continuous lace may be threaded through the second bores on each end and through both guide channels with both free ends then secured to an item, e.g. sewn into the hem of a pair of pants or attached to a backpack during manufacture. The device is then more or less permanently attached central to the lace. The lace may then be tightened or loosened in the same manner as described above.

In a preferred embodiment, the device is molded out of synthetic material. More particularly, in a preferred embodiment, the invention is molded out of a thermoplastic, such as high-impact polystyrene. However, other thermoplastics or materials are within the scope and contemplation of the invention. By way of example and with limitation, the invention could be machined out of aluminum or other material, or even separate panels could be brazed or welded together to form the device. Moreover, while only a single shape is shown in the drawing, one of ordinary skill will recognize that numerous shapes could be used without departing from the scope of the invention.

While in the preferred embodiment, the maximum cross-dimension of bore 28 is selected to be less than the diameter of an elastic lace in an unstretched state and greater than the diameter of the unstretched lace in a stretched state, it is within the scope and contemplation of the invention that the device be usable with nonelastic laces. In such an embodiment, the bore 28 should be of a size that when the non-elastic lace resides within bore 28, frictional forces between the walls of bore 28 and the lace prevent the lace from moving in either direction through the bore. In such an embodiment, a user will likely need to pull the lace to full tightness within the guide channel before pulling it laterally to lock into bore 28. Alternatively, a one-way cam may be associated with the first bore to retain the lace without relying on frictional forces.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

What is claimed is:

1. An apparatus comprising:

a single piece of panel material having two end panels, two side panels, and a top panel that define a volume, each end defining a first bore of a first cross-dimension and a first portion of a guide channel, the top defining a second portion of each guide channel, each second portion having a maximum cross-dimension greater than the first cross-dimension, wherein each guide channel is contiguous with the corresponding first bore, a retaining protrusion is formed at an intersection of the guide channel and the first bore, and each end further defines a second bore having a cross-dimension greater than the first cross-dimension.

2. The apparatus of claim 1 wherein a center of the second bore is disposed an approximately greater than or equal distance from a plane defined by the top panel as the retaining protrusion.

3. The apparatus of claim 1 wherein the material is a thermoplastic.

4. The apparatus of claim 3 wherein the thermoplastic is a high density polystyrene.

* * * * *